US011848120B2

(12) United States Patent
Visser

(10) Patent No.: US 11,848,120 B2
(45) Date of Patent: Dec. 19, 2023

(54) QUAD-SHIELD CABLE

(71) Applicant: PCT International, Inc, Tempe, AZ (US)

(72) Inventor: Leonard J. Visser, Huntsville, AR (US)

(73) Assignee: PCT International, Inc.

( * ) Notice: Subject to any disclaimer, the term of this patent is extended or adjusted under 35 U.S.C. 154(b) by 0 days.

(21) Appl. No.: 17/339,902

(22) Filed: Jun. 4, 2021

(65) Prior Publication Data

US 2022/0392668 A1 Dec. 8, 2022

Related U.S. Application Data

(60) Provisional application No. 63/035,095, filed on Jun. 5, 2020.

(51) Int. Cl.
*H01B 1/00* (2006.01)
*H01B 11/18* (2006.01)

(52) U.S. Cl.
CPC ..... *H01B 11/1869* (2013.01)

(58) Field of Classification Search
CPC ..... H01B 11/1869
See application file for complete search history.

(56) References Cited

U.S. PATENT DOCUMENTS 2,178,365 A 10/1939 Brobst
2,232,846 A 2/1941 Eli
2,669,695 A 2/1954 Bird
2,698,353 A 12/1954 Carr et al.
2,769,148 A 10/1956 Clogston
2,852,423 A 9/1958 Bassett
2,924,141 A 2/1960 Kinniburgh
3,076,235 A 2/1963 Rollins et al.
3,215,768 A 11/1965 Murphy
3,240,867 A 3/1966 Maddox
3,588,317 A 6/1971 Hutchins, Jr.
3,643,007 A * 2/1972 Roberts ..... H01B 11/1808 174/117 M
3,665,096 A 5/1972 Madle
4,092,452 A 5/1978 Hori et al.
4,096,346 A 6/1978 Stine et al.
4,117,260 A 9/1978 Wilkenloh
4,125,739 A 11/1978 Bow
4,221,926 A 9/1980 Schneider
4,340,771 A 7/1982 Watts
4,439,632 A 3/1984 Aloisio, Jr. et al.
4,472,595 A 9/1984 Fox et al.
4,477,693 A 10/1984 Krabec et al.
4,484,023 A 11/1984 Gindrup
4,487,996 A 12/1984 Rabinowitz et al.
(Continued)

FOREIGN PATENT DOCUMENTS

WO 2019202870 A1 10/2019

*Primary Examiner* — Pete T Lee
(74) *Attorney, Agent, or Firm* — THOMAS W. GALVANI, P.C.; Thomas W. Galvani

(57) ABSTRACT

A cable includes a conductor, an insulator surrounding the center conductor, and a shield surrounding the insulator, wherein the shield has two foil layers and two braid layers. Each foil layer includes two foil surfaces, each braid layer includes two braid surfaces, and only one of the foil surfaces of the two foil layers confronts only one of the braid surfaces of the two braid layers.

17 Claims, 3 Drawing Sheets

(56) References Cited

U.S. PATENT DOCUMENTS 4,515,992 A 5/1985 Gupta
4,557,560 A 12/1985 Bohannon, Jr. et al.
4,564,723 A 1/1986 Lang
4,569,704 A 2/1986 Bohannon, Jr. et al.
4,595,431 A 6/1986 Bohannon, Jr. et al.
4,641,110 A * 2/1987 Smith ..... H01B 11/206 333/243
4,642,417 A 2/1987 Ruthrof et al.
4,691,081 A 9/1987 Gupta et al.
4,694,122 A 9/1987 Visser
4,760,362 A 7/1988 Maki
4,894,488 A 1/1990 Gupta
4,965,412 A 10/1990 Lai et al.
5,043,538 A 8/1991 Hughey, Jr. et al.
5,043,539 A 8/1991 Connole et al.
5,068,497 A * 11/1991 Krieger ..... H01B 7/0054 338/214
5,194,291 A 3/1993 D'Aoust et al.
5,214,243 A * 5/1993 Johnson ..... H01R 9/0518 174/106 SC
5,329,064 A 7/1994 Tash et al.
5,414,213 A 5/1995 Hillburn
5,444,466 A 8/1995 Smyczek et al.
5,515,848 A 5/1996 Corbett, III et al.
5,538,586 A 7/1996 Swanson et al.
5,796,018 A 8/1998 Moyer et al.
5,796,042 A 8/1998 Pope
5,912,433 A 6/1999 Pulido et al.
5,949,018 A 9/1999 Esker
5,969,456 A 10/1999 Okamoto et al.
6,201,190 B1 * 3/2001 Pope ..... H01B 11/1826 174/102 R
6,284,374 B1 9/2001 Yamazaki et al.
6,326,551 B1 12/2001 Adams
6,384,337 B1 5/2002 Drum
6,417,454 B1 7/2002 Biebuyck
6,498,301 B1 12/2002 Pieper et al.
6,545,222 B2 4/2003 Yokokawa et al.
6,583,361 B2 6/2003 Clouet et al.
6,596,393 B1 7/2003 Houston et al.
6,610,931 B2 8/2003 Perelman et al.
6,734,364 B2 5/2004 Price et al.
6,770,819 B2 8/2004 Patel
6,800,809 B2 10/2004 Moe et al.
6,818,832 B2 11/2004 Hopkinson et al.
6,846,536 B1 1/2005 Priesnitz et al.
6,858,805 B2 2/2005 Blew et al.
6,915,564 B2 7/2005 Adams
6,997,999 B2 2/2006 Houston et al.
7,022,918 B2 4/2006 Gialenios et al.
7,052,283 B2 5/2006 Pixley et al.
7,084,343 B1 8/2006 Visser
7,127,806 B2 10/2006 Nelson et al.
7,157,645 B2 1/2007 Huffman
7,228,625 B1 6/2007 Zerebllov
7,468,489 B2 12/2008 Alrutz
7,566,236 B2 7/2009 Malloy et al.
9,728,304 B2 8/2017 Visser
10,068,686 B2 9/2018 Kumada
10,510,469 B2 12/2019 Kumada
10,573,980 B2 2/2020 Mathews
2001/0040042 A1 11/2001 Stipes
2002/0046849 A1 4/2002 Rapp et al.
2003/0150633 A1 8/2003 Hirakawa et al.
2004/0085183 A1 5/2004 Ha et al.
2005/0042960 A1 2/2005 Yeh et al.
2006/0034638 A1 2/2006 Kamijo et al.
2006/0048963 A1 3/2006 Nishinaka et al.
2007/0037419 A1 2/2007 Sparrowhawk
2008/0314636 A1 12/2008 Ogura
2009/0020712 A1 1/2009 Matsumoto
2009/0126984 A1 5/2009 Saneto et al.
2009/0133922 A1 5/2009 Okazaki et al.
2009/0151998 A1 6/2009 Fujiwara et al.
2009/0283296 A1 11/2009 Shimosawa et al.
2010/0276176 A1 11/2010 Amato
2011/0011638 A1 1/2011 Gemme et al.
2011/0011639 A1 * 1/2011 Visser ..... H01B 11/1008 174/105 R
2012/0255761 A1 10/2012 Shanai et al.
2013/0037304 A1 2/2013 Ikeda et al.
2014/0218642 A1 8/2014 Iwami
2015/0034360 A1 2/2015 Muto et al.
2015/0053950 A1 2/2015 Suematsu et al.
2015/0068907 A1 3/2015 Fujikawa et al.
2018/0025811 A1 * 1/2018 Lawrence ..... H02G 1/14 174/106 R
2019/0013559 A1 1/2019 Suenaga et al.
2019/0013560 A1 1/2019 Suenaga et al.
2019/0191601 A1 6/2019 Suenaga et al.
2019/0311821 A1 10/2019 Lawrence
2019/0348196 A1 11/2019 Hornung et al.
2020/0127421 A1 4/2020 Jones et al.
2020/0234855 A1 7/2020 Sagawa et al.

* cited by examiner

QUAD-SHIELD CABLE

CROSS-REFERENCE TO RELATED APPLICATIONS

This application claims the benefit of U.S. Provisional Application No. 63/035,095, filed Jun. 5, 2020, which is hereby incorporated by reference.

FIELD

The present specification relates generally to electronic devices, and more particularly to electronic and data cables.

BACKGROUND

Electronic devices and components used in and around homes and businesses produce ingress noise affecting radio-frequency ("RF") signals transmitted through nearby coaxial cables. Ingress noise can be caused by manufacturing or installation defects or imperfections in various electronic shielding. Conventional shielding that may have once been adequate is becoming less and less effective with the continuing proliferation of more and more electronic devices. Ingress noise is a serious problem impacting signal quality in television, voice, security, and broadband services.

A variety of cables and devices use shields to reduce this outside electrical interference or noise that could affect an RF signal travelling through the cable or other system. The shielding also helps prevent the internal signal from radiating from the cable or other system and interfering with other devices. Conventionally, cables include one, two, or three layers of foil and braid.

"Quad-shield" cables include a center conductor, an insulator, four layers of shielding, and an outer protective jacket. An exemplary conventional quad-shield cable 10 is shown in FIG. 1. The conventional quad-shield cable employs a foil/braid/foil/braid construction. The below description uses the terms "foil," "foil layer," "tape," "laminated tape," "shielding tape," "shielding laminate tape," and combinations or variations thereof interchangeably as is common in the industry. Similarly, the terms "braid" and "braid layer" are also used interchangeably.

In FIG. 1, a center conductor 11 is disposed at the geometric center of the cable 10. An insulator 12 surrounds the center conductor 11. Shielding surrounds the insulator 12: a first foil 13 closest to the insulator 12, a first braid 14 encircling the first foil 13, a second foil 15 encircling the first braid 14, and a second braid 16 encircling the second foil 15. Finally, a jacket 17, such as a PVC jacket, wraps the second foil 15 and contains each of the aforementioned parts. This sequential foil/braid/foil/braid layering is common and conventional for quad-shield cables 10. The foil layers 13 and 15 are formed from thin, flat strips of metal rolled into a cylinder, and thus have longitudinal overlap seams 18 and 19 extending axially.

For many applications, it is desirable to maximize the RF shielding performance of a cable. To this end, some cable manufacturers have turned to the use of four layers of shielding as described above with respect to conventional quad-shield cables. Each layer individually increases the total shielding performance of the cable. However, while the foil layers 13 and 15 provide complete optical coverage, they are relatively thin and do not actually prevent RF energy ingress; some RF energy inevitably penetrates. In addition, the overlap seams 18 and 19 are known to leak RF energy, resulting in an additional loss of shielding effectiveness. This problem has been addressed without solution. Various types of edge folds have been proposed to minimize this seam leakage effect, but no solutions have eliminated the RF leakage. As an additional problem, when the seams 18 and 19 of both foil layers 13 and 15 are oriented radially one above the other, the seam leakage rate is maximized; RF energy will follow the shortest path through the first seam 18 and then through the second seam 19 disposed over it.

Unfortunately, problems such as these are essentially inherent conventional quad-shield cable design. The construction techniques used to manufacture quad-shield cables are predisposed to introducing RF leakage problems. Quad-shield cables are typically manufactured in multiple stages. Specifically, a conventional quad-shield cable is made with a first pass through a braider, in which the first foil 13 and first braid 14 are applied to the conductor 11 and insulator 12 and wound onto a spool. This semi-finished cable is then fed into another braider where the second foil 15 and second braid 16 are applied over the previously-applied layers. It is not possible to control the radial orientation of the two foil seams 18 and 19 during this process. In each stage of manufacturing, the orientation of the seams 18 and 19 simply cannot be controlled. Neither the production equipment nor the construction techniques enable controlled orientation. Thus, the relative orientation of the seams 18 and 19 in finished quad-shield cables is random. This means that the RF shielding performance in any given cable varies randomly from a maximum, when the seams 18 and 19 are radially separated by one hundred eighty degrees, to a minimum, when the seams 18 and 19 are oriented one above the other. This, in turn, means that conventional quad-shield cables lack consistency in their performance.

Like other cables, conventional quad-shield cables are exposed to repeated flexing both during and after installation in the field. Unfortunately, the foil layers are thin, fragile, and do not handle this flexing well. Flexion of the cable just a few times will cause the foil layers to begin to decay, degrading their shielding effectiveness. Conventional quad-shield cables have one surface of the inner foil 13 and two surfaces of the outer foil 15 in contact with the braids 14 and 16, for a total of three surfaces that may be abraded when the cable is flexed. It has been found by the inventor that this creates a high potential for wear: most of the foil surfaces will degrade and lose their RF shielding performance, especially over the operational lifetime of the cable.

Quad-shield cables also suffer degradation when fitted with connectors. For proper installation of a male F-type connector on a conventional quad-shield cable, a cable stripping tool is normally used to prepare the cable end. A stripping tool has a first blade which cuts through the cable, nearly to the center conductor, and a second blade which cuts only through the jacket. Forward of the first cut, all the cable layers are removed, including the insulator, thereby exposing the center conductor. In front of the second cut, however, only a short section of jacket is removed, thereby exposing the outer-most shielding layer, the braid 16, much as illustrated in FIG. 1. Conventionally, the quad-shield cable is further prepared by folding the outer braid 16 back over the jacket. Then, a short section of the outer foil 15 is carefully cut and peeled away. Finally, the inner braid 14 is folded back over both the outer braid 16 and the jacket 17. These operations are necessary to allow the cable to be inserted into the F-type connector. However, these operations also damage the integrity of the shield, because a section of the outer three layers has been removed. As a result, over this prepared section of cable, only the inner foil 13 is left to prevent RF leakage. Moreover, this multi-step preparation process takes time and is generally done in the field by a technician, thereby introducing the potential for performance degradation if the cable is prepared improperly. The operator can cut too far through the cable, severing braid layers, or can fold the layers of the shield improperly, thereby reducing cable performance.

As is made clear from the above, conventional quad-shield cables have many drawbacks, considering construction, installation, consistency, performance, and durability characteristics. An improved quad-shield cable is needed.

SUMMARY

In an embodiment, a cable includes a conductor, an insulator surrounding the center conductor, and a shield surrounding the insulator, wherein the shield has two foil layers and two braid layers. Each foil layer includes two foil surfaces, each braid layer includes two braid surfaces, and only one of the foil surfaces of the two foil layers confronts only one of the braid surfaces of the two braid layers.

The two foil layers are in confrontation with each other, and the two braid layers are in confrontation with each other. The two braid layers surround the two foil layers. The two foil layers include an inner foil layer and an outer foil layer surrounding the inner foil layer, and the two braid layers include an inner braid layer and an outer braid layer surrounding the inner braid layer. The two foil layers have longitudinal seams which are circumferentially offset from each other. In some embodiments, the longitudinal seams are diametrically offset from each other.

In another embodiment, a cable includes two foil layers and two braid layers. Each foil layer includes two foil surfaces and each braid layer includes two braid surfaces. Only one of the foil surfaces contacts only one of the braid layers.

The two foil layers are in confrontation with each other, and the two braid layers are in confrontation with each other. The two braid layers surround the two foil layers. The two foil layers include an inner foil layer and an outer foil layer surrounding the inner foil layer, and the two braid layers include an inner braid layer surrounding the outer foil layer and an outer braid layer surrounding the inner braid layer. The two foil layers have longitudinal seams which are diametrically offset from each other. In some embodiments, the cable includes a conductor, an insulator surrounding the conductor, a first of the two foil layers surrounding the insulator, and a second of the two foil layers surrounding the first of the two foil layers. A first of the two braid layers surrounds the second of the two foil layers, and a second of the two braid layers surrounds the first of the two braid layers.

In yet another embodiment, a cable includes two foil layers and two braid layers. Each of the foil layers has an inner foil surface and an opposed outer foil surface, and each of the braid layers has an inner braid surface and an opposed outer braid surface. Only a one of the outer foil surfaces of the foil layers is in contact with only a one of the inner braid surfaces of the braid layers.

The two foil layers are in confrontation with each other, and the two braid layers are in confrontation with each other. The two braid layers surround the two foil layers. The two foil layers include an inner foil layer and an outer foil layer surrounding the inner foil layer, and the two braid layers include an inner braid layer surrounding the outer foil layer and an outer braid layer surrounding the inner braid layer. The two foil layers have longitudinal seams which are diametrically offset from each other. In some embodiments, the cable includes a conductor, an insulator surrounding the conductor, a first of the two foil layers surrounding the insulator, and a second of the two foil layers surrounding the first of the two foil layers. A first of the two braid layers surrounds the second of the two foil layers, and a second of the two braid layers surrounds the first of the two braid layers.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
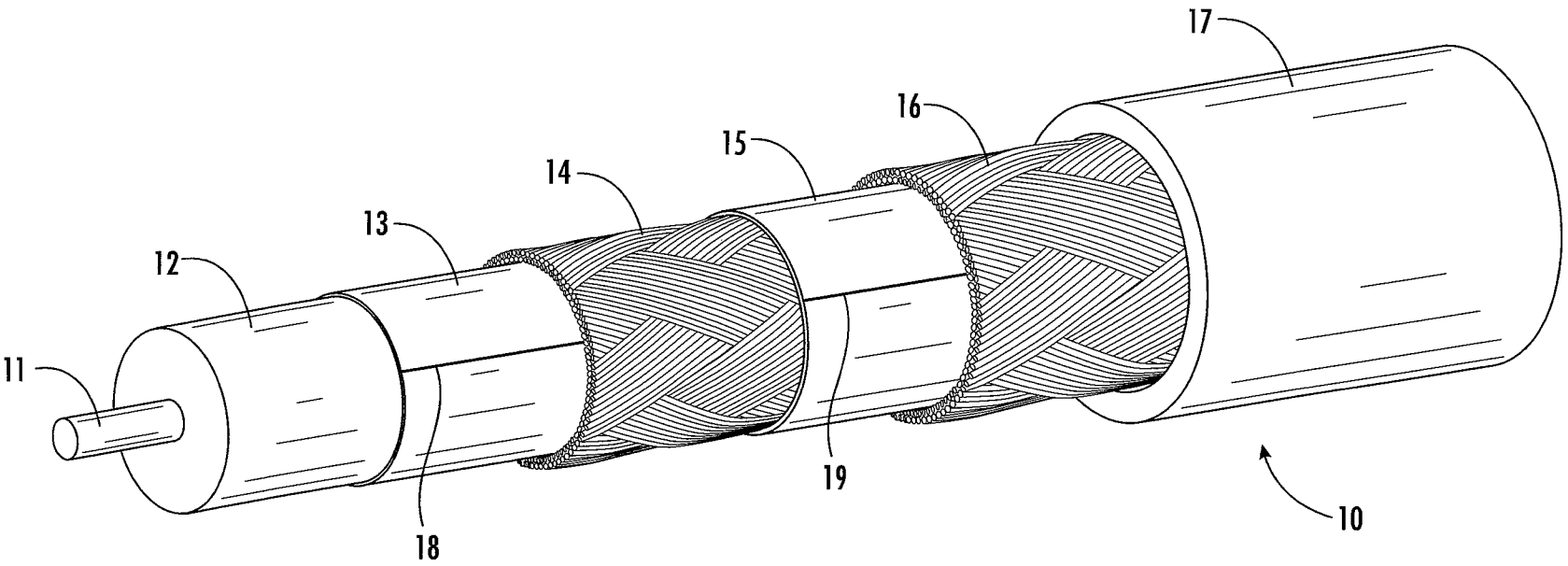
FIG. 1 (PRIOR ART)
FIG. 1 is a side perspective view of a prior art quad-shield coaxial cable.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. The diction used herein is meant to be readable and informational rather than to delineate and limit the specification; therefore, the scope and spirit of the specification should not be limited by the following description and its language choices.

Figure 2:
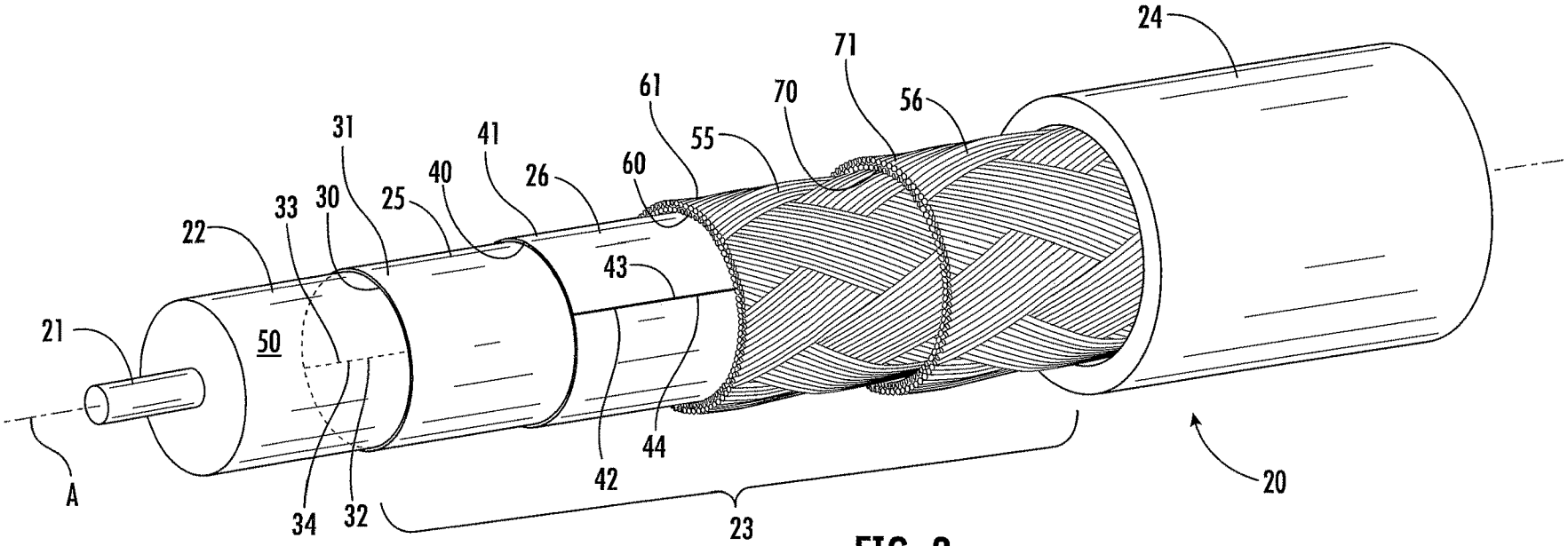
FIG. 2 is a side perspective view of an inventive quad-shield cable.

FIG. 2 is a side perspective view of an inventive quad-shield cable 20 (hereinafter "QS cable 20" or just "cable 20"). The QS cable 20 includes a center conductor 21 and an insulator 22 encircling and surrounding the center conductor 21. A shield 23 encircles and surrounds the insulator 22. An outer protective jacket 24 encircles and surrounds the shield 23, thereby enclosing or encapsulating the QS cable 20. The cable 20 has a longitudinal axis A extending along the entire length of the cable 20 and about which the cable 20 is rotationally symmetric.

The center conductor 21 is preferably a single solid wire, constructed from copper-clad steel. In other embodiments, however, the center conductor 21 is multiple wires, such as stranded wire, or may be constructed from other suitably conductive materials, such as copper, aluminum, copper-plated steel, or copper-plated aluminum.

The insulator 22, a dielectric insulator, is cylindrical and circumferentially encircles and surrounds the center conductor 21. The insulator 22 may have any suitable diameter, generally between about approximately 0.040 inches (approximately 1.016 millimeters) and approximately 0.600 inches (approximately 15.24 millimeters), but not necessarily so limited. The insulator 22 is solid and cylindrical, preferably formed foam polyethylene, polypropylene, or fluorinated ethylene propylene.

The shield 23 is a conductive portion of the cable 20 surrounding the insulator 22. The shield 23 is a four-layer shield: it has two foil layers and two braid layers. The shield 23 includes an inner or first foil layer 25 and an outer or second foil layer 26 encircling and surrounding the inner foil layer 25, in confrontation and direct contact with the inner foil layer 25.

The inner foil layer 25 has an inner surface 30 and an outer surface 31. When the inner foil layer 25 is formed, the inner and outer surfaces 30 and 31 are each planar, generally flat and smooth, have no projections or indentations into or out of the plane in which they lie, and are free of discontinuities. When the foil layer 25 is formed into the cylindrical roll shown in FIG. 2, it maintains this freedom from discontinuities. The foil layer 25 is thin, preferably less than approximately 0.005 inches (approximately 0.127 millimeters) in thickness, and the inner and outer surfaces 30 and 31 are parallel to each other locally.

As can be seen in FIG. 2, the inner foil layer 25 has a longitudinal seam 32 extending parallel to the axis A of the cable 20. In FIG. 2, the seam 32 is on the far side of the cable 20 and is hidden from view; for this reason it is shown in broken line. The seam 32 is formed by two opposed longitudinal edges 33 and 34 of the foil layer 25. In some embodiments, the edges 33 and 34 overlap to form the seam 32. In other embodiments, the edges 33 and 34 meet and abut each other to form the seam 32. In other embodiments, the edges 33 and 34 form an edge-shorting fold: they fold over each other to form the seam 32. In the embodiment shown in FIG. 2, the edges 33 and 34 abut, such that each edge 33 and 34 can be seen in this view. However, their arrangement is not so limited, and description of this arrangement should not be construed to so limit them.

The outer foil layer 26 is just outside the inner foil layer 25. The outer foil layer 26 has an inner surface 40 and an outer surface 41. When the outer foil layer 26 is formed, the inner and outer surfaces 40 and 41 are each planar, generally flat and smooth, have no projections or indentations into or out of the plane in which they lie, and are free of discontinuities. When the outer foil layer 26 is formed into the cylindrical roll shown in FIG. 2, it maintains this freedom from discontinuities. The foil layer 26 is thin, preferably less than approximately 0.005 inches (approximately 0.127 millimeters) in thickness, and the inner and outer surfaces 30 and 31 are parallel to each other locally.

As can be seen in FIG. 2, the outer foil layer 26 has a longitudinal seam 42 extending parallel to the axis A of the cable 20. The seam 42 is formed by two opposed longitudinal edges 43 and 44 of the foil layer 26. In some embodiments, the edges 43 and 44 overlap to form the seam 42. In other embodiments, the edges 43 and 44 meet and abut each other to form the seam 42. In other embodiments, the edges 43 and 44 form an edge-shorting fold: they fold over each other to form the seam 42. In the embodiment shown in FIG. 2, the edges 43 and 44 abut, such that each edge 43 and 44 can be seen in this view. However, their arrangement is not so limited, and description of this arrangement should not be construed to so limit them.

The seams 32 and 42 are diametrically offset and opposed from each other; one seam 32 extends along one side of the cable 20 and the other seam 42 extends along the other, opposite side of the cable 20. The seams 32 and 42 are parallel to each other, each parallel to the longitudinal axis A. This is a preferred, but not requisite, arrangement and orientation of the seams 32 and 42. In other embodiments, the seams 32 and 42 are otherwise circumferentially offset from each other, such that they are not registered on top of each other. In yet other embodiments, the seams 32 and 42 may be registered atop or nearly atop each other. The arrangement and orientation of the seams 32 and 42 with respect to each other is a characteristic of the cable 20 which the manufacturer can control during construction of the QS cable 20 by altering the orientation of the folding tool which applies the inner and outer foil layers 25 and 26 to the insulator 22.

As shown in FIG. 2, the inner foil layer 25 is applied directly to the insulator 22, in confrontation therewith. The insulator 22 has an outer surface 50, and the inner surface 30 of the inner foil layer 25 directly and continuously contacts this outer surface 50 along the entire length and circumference of the insulator 22. In some embodiments, an adhesive applied between the inner surface 30 of the inner foil layer 25 and the outer surface 50 of the insulator 22 adheres the inner foil layer 25 to the insulator 22. Adhering the inner foil layer 25 to the insulator 22 can assist in making later installation of a connector on the cable 20 easier, because it prevents the foil layers 25 and 26 from lifting up and interrupting or blocking application of the connector onto the cable. In other embodiments, the inner foil layer 25 tightly encircles and conforms to the insulator 22 without adhesive.

The inner foil layer 25 is disposed between the insulator 22 and the outer foil layer 26. The inner foil layer 25 contacts no part of the cable 20 other than the insulator 22 and the outer foil layer 26.

The outer foil layer 26 directly overlies the inner foil layer 25. The outer foil layer 26 overlies, encircles, and surrounds the inner foil layer 25 along the entire length and circumference of the inner foil layer 25. The inner surface 40 of the outer foil layer 26 directly and continuously contacts the outer surface 31 of the inner foil layer 25.

These foil layers 25 and 26 are both formed from large sheets. The material of these sheets is preferably either flexible foil tape or laminate. The sheets are laid out as flat sheets, cut into narrow flat strips, and then rolled or folded into the cylindrical shape they have on the cable 20. When formed to the cylindrical shape of the cable 20, the foil layers 25 and 26 must include seams 32 and 42, and these seams 32 and 42 assume an orientation depending on the method of application of the foil layers 25 and 26 to the insulator 22. As noted above, a preferred manufacturing technique orients the seams 32 and 42 parallel to each other and to the axis A, but circumferentially offset from each other. It has been unexpectedly found that a circumferential offset of the seams 32 and 42, and a diametrically opposite offset especially, assists in the improvement of the shield effectiveness of the cable 20.

In addition to the foil layers 25 and 25, the shield 23 also includes two braid layers: an inner or first braid layer 55 and an outer or second braid layer 56. The braid layers 55 and 56 confront and directly contact each other. The inner braid layer 55 encircles and surrounds the outer foil layer 26, and the outer braid layer 56 encircles and surrounds the inner braid layer 55. These braid layers 55 and 56 include a conductive RF shield or electromagnetic radiation shield. In embodiments, the braid layers 55 and 56 include a conductive screen, mesh, or braid. In other embodiments, they have a perforated configuration defining a matrix, grid, or array of openings. As shown in FIG. 2, the braid layers 55 and 56 preferably, but not necessarily, are woven as a mesh. The braid layers 55 and 56 each use any suitable weave pattern. The braid layers 55 and 56 are preferably, but not necessarily, constructed from aluminum, copper, or a suitable combination of aluminum and copper.

The inner braid layer 55 has an inner surface 60 and an outer surface 61. The interwoven nature of the individual elements of the braid layer 55 characterize the inner and outer surfaces 60 and 61.

Similarly, the outer braid layer 56 has an inner surface 70 and an outer surface 71. The interwoven nature of the individual elements of the braid layer 56 characterize the inner and outer surfaces 70 and 71. Each of the inner and outer braid layers 55 and 56 is rotationally symmetric about the longitudinal axis A.

As shown in FIG. 2, the inner braid layer 55 is applied directly to the outer foil layer 26, in confrontation therewith. The inner surface 60 of the inner braid layer 55 directly and continuously contacts the outer surface 41 of the outer foil layer 26 along the entire length and circumference of the outer foil layer 26. This is the sole location at which either of the braid layers 55 and 56 contact either of the foil layers 25 and 26.

The outer braid layer 56 directly overlies the inner braid layer 55. The outer braid layer 56 overlies, encircles, and surrounds the inner braid layer 55 along the entire length and circumference of the inner braid layer 55. The outer braid layer 56 is disposed between the inner braid layer 55 and the jacket 24. The outer braid layer 56 contacts no part of the cable 20 other than the inner braid layer 55 and the jacket 24. The inner surface 70 of the outer braid layer 56 directly and continuously contacts the outer surface 61 of the inner braid layer 55.

The jacket 24 encircles and surrounds the outer braid layer 56, thereby encapsulating and protecting the cable 10. The jacket 24 is flexible, constructed from a material having flexible and sunlight-resistant characteristics such as polyvinyl chloride ("PVC"), rubber, or the like. The jacket 24 has an insulative characteristic which protects both the performance of the cable 20 and the health and safety of anyone handling the cable 20. The jacket 24 further guards the internal components of the cable 20 from damage from impact or the environment.

It has been unexpectedly discovered that the QS cable 20 maintains shielding effectiveness despite normal wear and tear. Conventional quad-shield cable is known to suffer rapid shielding effectiveness decay after the typical cyclical flexing stresses of aerial, in-home, or head-end installations. However, the QS cable 20 disclosed herein does not experience such degradation, demonstrating an unexpectedly improved shielding effectiveness over conventional quad-shield cables. The improved shielding effectiveness may be assisted by placing the two foil layers 25 and 26 against each other. The improved shielding effectiveness may also be assisted by placing the two braid layers 65 and 66 against each other. The improved shielding effectiveness may also be assisted by placing the two foil layers 25 and 26 against the insulator 22. The improved shielding effectiveness may also be assisted by encircling the two foil layers 25 and 26 with the two braid layers 65 and 66. The improved shielding effectiveness may also be assisted by encircling the two braid layers 65 and 66 with the jacket 24. The improved shielding effectiveness may also be assisted by placing only one of the two foil layers 25 and 26 against only one of the two braid layers 55 and 56. In the arrangement disclosed herein, only one of the foil layers—the outer foil layer 26—contacts only one of the braid layers—the inner braid layer 55. Moreover, only one of the foil surfaces—the outer surface 41 of the outer foil layer 26—contacts only one of the braid surfaces—the inner surface 60 of the inner braid layer 55.

Figure 3:
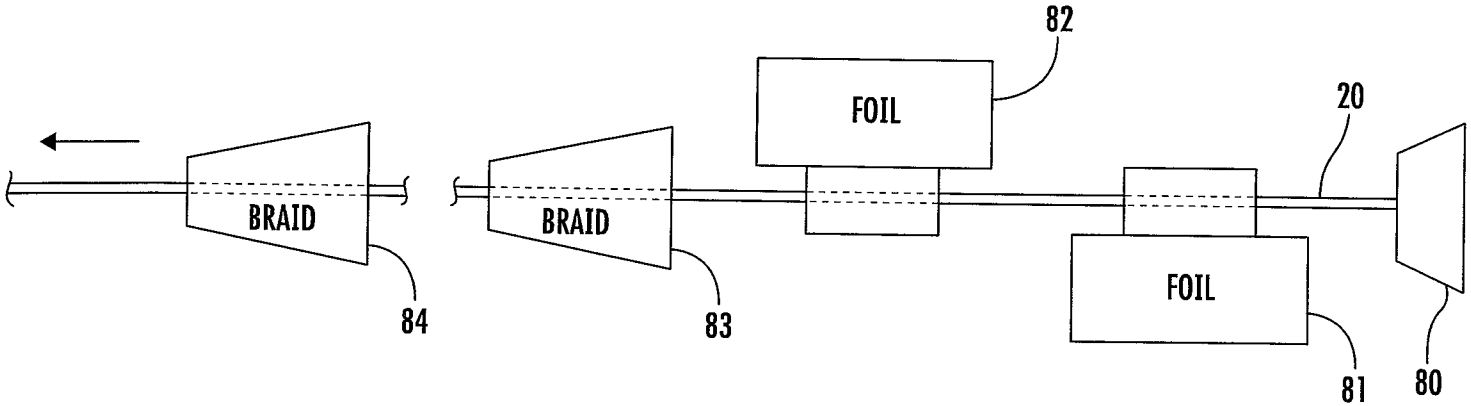
FIG. 3 is a schematic illustration of a portion of a process for manufacturing the cable of FIG. 2.

FIG. 3 shows a schematic representation of a portion of a process for manufacturing the cable 20. The process moves through two machines from right to left to construct the cable 20, and reference characters are used in this description but not shown in the drawings to indicate correspondence to the cable 20 shown in FIG. 2. A center conductor 21, already encircled by an insulator 22, leaves a plant 80 and enters a first processing machine. A first folding tool 81 applies the inner foil layer 25 to the insulator 22. As shown in FIG. 3, the folding tool 81 has a first, upright orientation. The folding tool 81 places the flat inner foil layer 25 against the insulator 22 and then folds it around the insulator 22. This applies the inner layer 25 with the seam 32 in a first position.

Next, in a second processing machine, a second folding tool 82 applies the outer foil layer 26. The second folding tool 82 is identical to the first folding tool 81 but has a second orientation which is inverted or rotated one hundred eighty degrees with respect to the first orientation of the first folding tool 81. The second folding 82 places the flat outer foil layer 26 against the inner foil layer 25 on the insulator 22 and then folds it around the inner foil layer 25. This applies the outer layer 26 with the seam 42 in a second position, opposite the seam 32. In other words, when the second folding tool 82 folds the outer foil layer 26 around the inner foil layer 25, the seam 42 of the outer foil layer 26 is diametrically opposed to the seam 32 in the inner foil layer 25.

The seam 42 is opposed to the 32 because the folding tools 81 and 82 are inverted with respect to each other. However, the first and second folding tools 81 and 82 can be arranged differently, so as to alter the radial orientation of the two foil layers 25 and 26 at any relative angle.

Once the outer foil layer 26 is applied, the inner and outer braids 55 and 56 are formed over the outer foil layer 26. Two braiding tools 83 and 84 are downstream from the second folding tool 82. The first braiding tool 83 applies the inner braid layer 55 directly over the outer foil layer 26, and the second braiding tool 84 applies the outer braid layer 56 directly over the inner braid layer 55.

With this construction method, the QS cable 20 has only one surface of a foil layer in contact with a braid layer and no more. The outer surface 41 of the outer foil layer 26 is in contact with the inner surface 60 of the inner braid layer 55. The other surfaces of the foil layers 25 and 26 do not contact the braid layers 55 and 56, and the other surfaces of the braid layers 55 and 56 do not contact the foil layers 25 and 26. As such, abrasive action is minimized, and the QS cable 20 can withstand more flexion than a conventional quad-shield cable without a corresponding degradation of RF shielding performance.

The QS cable 20 also offers superior connectivity for a male F-type connector. A conventional cable stripping tool is still used to prepare the end of the QS cable 20. The stripping tool has a first blade which cuts through the QS cable 20 as shown in FIG. 2, nearly to the center conductor 21, and a second blade which cuts only through the jacket 24. Forward of the first cut, all the cable layers are removed, thereby exposing the center conductor 21. Forward of the second cut, only a short section of the jacket 24 is removed exposing the shield 23. The QS cable 20 is then further prepared by folding the outer braid 56 back over the jacket 24. Next, the inner braid 55 is folded back over the outer braid 56 and the jacket 24. Alternatively, the inner and outer braids 55 and 56 are folded back together.

These operations allow the QS cable 20 to be inserted into the F-type connector. Neither the inner foil layer 25 nor the outer foil layer 26 are removed; both are left intact and in place. This allows a technician to prepare the cable 20 much faster than a conventional cable. Moreover, the two foil layers 25 and 26 provide RF shielding performance along their entire lengths, including within the male connector; leaving them intact provides RF shielding entirely to the mating surface of the female F port.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A cable comprising:

two foil layers and two braid layers, wherein:

the two foil layers have longitudinal seams which are diametrically offset from each other;

each foil layer includes two foil surfaces and each braid layer includes two braid surfaces; and only one of the foil surfaces contacts only one of the braid layers.

2. The cable of claim 1, wherein:

the two foil layers are in confrontation with each other; and the two braid layers are in confrontation with each other.

3. The cable of claim 1, wherein the two braid layers surround the two foil layers.

4. The cable of claim 1, wherein:

the two foil layers comprise an inner foil layer and an outer foil layer surrounding the inner foil layer; and the two braid layers comprise an inner braid layer surrounding the outer foil layer and an outer braid layer surrounding the inner braid layer.

5. The cable of claim 1, further comprising:

a conductor;

an insulator surrounding the conductor; and a first of the two foil layers surrounding the insulator and a second of the two foil layers surrounding the first of the two foil layers.

6. The cable of claim 5, wherein:

a first of the two braid layers surrounds the second of the two foil layers; and a second of the two braid layers surrounds the first of the two braid layers.

7. A cable comprising:

a conductor;

an insulator surrounding the conductor; and a shield surrounding the insulator, the shield comprising two foil layers and two braid layers, wherein each foil layer includes two foil surfaces, each braid layer includes two braid surfaces, and only one of the foil surfaces of the two foil layers confronts only one of the braid surfaces of the two braid layers;

wherein the two braid layers have longitudinal seams which are diametrically offset from each other.

8. The cable of claim 7, wherein:

the two foil layers are in confrontation with each other; and the two braid layers are in confrontation with each other.

9. The cable of claim 7, wherein the two braid layers surround the two foil layers.

10. The cable of claim 7, wherein:

the two foil layers comprise an inner foil layer and an outer foil layer surrounding the inner foil layer; and the two braid layers comprise an inner braid layer and an outer braid layer surrounding the inner braid layer.

11. The cable of claim 7, wherein the two foil layers have longitudinal seams which are circumferentially offset from each other.

12. A cable comprising:

two foil layers and two braid layers, the two foil layers having longitudinal seams which are diametrically opposed from each other;

wherein each of the foil layers has an inner foil surface and an opposed outer foil surface;

each of the braid layers has an inner braid surface and an opposed outer braid surface; and only a one of the outer foil surfaces of the foil layers is in contact with only a one of the inner braid surfaces of the braid layers.

13. The cable of claim 12, wherein:

the two foil layers are in confrontation with each other; and the two braid layers are in confrontation with each other.

14. The cable of claim 12, wherein the two braid layers surround the two foil layers.

15. The cable of claim 12, wherein:

the two foil layers comprise an inner foil layer and an outer foil layer surrounding the inner foil layer; and the two braid layers comprise an inner braid layer surrounding the outer foil layer and an outer braid layer surrounding the inner braid layer.

16. The cable of claim 12, further comprising:

a conductor;

an insulator surrounding the conductor; and a first of the two foil layers surrounding the insulator and a second of the two foil layers surrounding the first of the two foil layers.

17. The cable of claim 16, wherein:

a first of the two braid layers surrounds the second of the two foil layers; and a second of the two braid layers surrounds the first of the two braid layers.

* * * * *